US012716626B2

(12) United States Patent
Zahlecker et al.

(10) Patent No.: US 12,716,626 B2
(45) Date of Patent: Aug. 25, 2026

(54) ELECTROMOTIVE EXPANSION VALVE AND REFRIGERATION CIRCUIT

(71) Applicant: MAHLE International GmbH, Stuttgart (DE)

(72) Inventors: Manuel Zahlecker, Neuhausen (DE); Jeffrey Van Delden, Wendlingen (DE)

(73) Assignee: Mahle International GmbH (DE)

( * ) Notice: Subject to any disclaimer, the term of this patent is extended or adjusted under 35 U.S.C. 154(b) by 267 days.

(21) Appl. No.: 18/621,084

(22) Filed: Mar. 28, 2024

(65) Prior Publication Data

US 2024/0344747 A1 Oct. 17, 2024

(30) Foreign Application Priority Data

Mar. 29, 2023 (DE) ..... 102023202886.7

(51) Int. Cl.
*F25B 41/35* (2021.01)

(52) U.S. Cl.
CPC ..... *F25B 41/35* (2021.01); *F25B 2600/2513* (2013.01)

(58) Field of Classification Search
CPC ..... F25B 41/35; F25B 2600/2513
See application file for complete search history.

(56) References Cited

U.S. PATENT DOCUMENTS

2015/0020540 A1* 1/2015 Wakisaka ..... F16K 31/04 62/528
2020/0232690 A1* 7/2020 Lan ..... G01R 33/0047

FOREIGN PATENT DOCUMENTS

| | | | |
|---|---|---|---|
| DE | 102007029738 | A1 | 1/2009 |
| EP | 3832228 | A1 | 6/2021 |
| JP | 2000266194 | A | 9/2000 |
| JP | 2007024186 | A | 2/2007 |
| JP | 2019132394 | A | 8/2019 |
| WO | 2020221784 | A1 | 11/2020 |
| WO | 2022184288 | A1 | 9/2022 |

OTHER PUBLICATIONS

English abstract for EP-3832228.
English abstract JP-2000266194.
English abstract JP-2019132394.
German Search Report for DE-102023202886.7, dated Jan. 31, 2024.
English abstract for JP-2007024186.

* cited by examiner

*Primary Examiner* — Larry L Furdge
(74) *Attorney, Agent, or Firm* — Fishman Stewart PLLC

(57) ABSTRACT

An electromotive expansion valve for a refrigeration circuit for expanding a two-phase refrigerant includes a hydraulic flange for integrating the expansion valve into the refrigeration circuit, a housing fastened to the hydraulic flange, a valve body unit for controlling a flow opening of the hydraulic flange, and an electric motor for axially adjusting the valve body unit. A rotor of the motor includes a rotor sleeve with an internal threading. The valve body unit includes a drive rod extending axially into the rotor sleeve. The drive rod includes an external threading engaging the internal threading of the rotor sleeve. The drive rod extends axially through a bearing bushing. A torque-proof axial guide is disposed between the bearing bushing and the drive rod such that the valve body unit is torque-proof while the rotor is turning and adjusts itself axially.

20 Claims, 7 Drawing Sheets

ELECTROMOTIVE EXPANSION VALVE AND REFRIGERATION CIRCUIT

CROSS-REFERENCE TO RELATED APPLICATION

This application claims priority to German Patent Application No. DE102023202886.7, filed on Mar. 29, 2023, the content of which is hereby incorporated by reference in its entirety.

TECHNICAL FIELD

The invention relates to an electromotive expansion valve for a refrigeration circuit for expanding a two-phase refrigerant. The invention further relates to a refrigeration circuit equipped with such an expansion valve.

BACKGROUND

A generic electromotive expansion valve is known from WO 2020/221784A1, for example, and comprises a hydraulic flange, a housing, a valve body unit, and an electric motor. The hydraulic flange is used in order to integrate the expansion valve into the refrigeration circuit, wherein the hydraulic flange comprises a refrigerant path for conducting the refrigerant and a flow opening configured in the refrigerant path through which the refrigerant can flow. The housing is fastened to the hydraulic flange. The valve body unit is used in order to control the flow opening configured in the hydraulic flange. The electric motor is used in order to axially adjust the valve body unit. For this purpose, the electric motor comprises a stator, which is arranged in the housing in a torque-proof manner and comprises at least one stator coil. Furthermore, the electric motor comprises a rotor, which is mounted in the housing concentrically to the stator in a manner so as to be rotated about an axis of rotation and comprises a cylindrical magnet arrangement having at least one permanent magnet. The electric motor is also equipped with a can, which is arranged in the housing in a torque-proof manner concentrically to the axis of rotation and radially between the rotor and the stator. The can is closed at a first axial end with a bearing bushing, which is inserted into a housing opening designed concentrically to the axis of rotation on the housing and has a bushing opening arranged concentrically to the axis of rotation. The can is closed at a second axial end with a can base. The valve body unit penetrates the bushing opening concentrically to the axis of rotation and comprises a needle body. In the known expansion valve, the needle body controls the cross-section of the flow opening through which refrigerant can flow. In this respect, the known expansion valve is designed in one-stage manner. A guide bushing is provided in the known expansion valve, being connected to the bearing bushing in a torque-proof manner and having a guide opening for guiding the needle body coaxially to the axis of rotation. For this purpose, the needle body passes through the guide opening. In the known expansion valve, the rotor also comprises a rotor shaft, which is connected to the magnet arrangement in a torque-proof manner and has a blind hole opening on the front side. The needle body is arranged in this blind hole opening in an axially adjustable manner with an end section facing away from the flow opening and is pretensioned by means of a pretensioning spring against a drive ring configured on the rotor shaft. The rotor shaft has an external threading which interacts with an internal threading formed on the guide bush in such a way that rotation of the rotor simultaneously causes axial adjustment of the rotor, wherein the rotor entrains the needle body coupled to it.

A further electromotive expansion valve is known from WO 2022/184288 A1, in which the rotor shaft has an external threading which interacts with an internal threading formed on a driver body. The driver body is arranged in an axially adjustable and torque-proof manner in a guide bushing and is connected to the valve body unit for axial force transmission. The valve body unit comprises a cylindrical stopper body, which is axially adjustable on the hydraulic flange and has a control contour for controlling the flow opening. The stopper body has a stopper opening in the control contour. The needle body is axially adjustable on the stopper body and controls the stopper opening. Between the needle body and the stopper body, a driver contour is designed, which carries the stopper body along from a predefined opening stroke of the needle body. The driver body, which is axially driven by the rotor shaft, is coupled to the needle body for axial force transmission. This known expansion valve is designed as a two-stage expansion valve by way of the needle body and the stopper body.

A further two-stage expansion valve is known from JP 2007 024 186 A. Here, too, the stopper body is axially adjustable on the hydraulic flange, and the needle body is axially adjustable on the stopper body and is thus coupled via a driver contour. In this known expansion valve, the rotor comprises a rotor sleeve, which is connected to the magnet arrangement in a torque-proof manner and is connected to a threaded sleeve in a torque-proof manner. The threaded sleeve has an internal threading that interacts with an external threading that is configured on a threaded tube that is connected to the bearing bushing in a torque-proof manner. The needle body extends through the threaded tube and is connected to the rotor for axial force transmission.

SUMMARY

The present invention addresses the problem of specifying an improved, or at least a different, embodiment for an expansion valve of the type described above or for a refrigeration circuit equipped therewith, which is characterized in particular by a compact design and/or by a cost-effective manufacturability and/or by a simple adaptation to different operating conditions.

According to the invention, this problem is solved by the subject-matter of the independent claim(s). Advantageous embodiments are the subject-matter of the dependent claim(s).

The invention is based on the general idea of integrating the drive coupling between the valve body unit and the rotor into the rotor in such a way that when the rotor rotates, the valve body unit is directly adjusted axially relative to the rotor. An axial adjustment of rotor components is not required, so that the electric motor can be constructed in an axially compact manner. Furthermore, mechanical losses can be reduced by the integral design, so that the electric motor can provide more drive power and/or be designed smaller.

In detail, the invention proposes to equip the rotor with a rotor sleeve which is arranged in the magnet arrangement concentrically to the axis of rotation, which is connected to the magnet arrangement in a torque-proof manner and axially fixed manner and which has an internal threading. The valve body unit is equipped with a drive rod, which extends axially up into the rotor sleeve and, in the region of the rotor sleeve, has an external threading which is in engagement with the internal threading of the rotor sleeve.

The drive rod extends through the bushing opening and comprises the needle body and/or is connected to the needle body in a torque-proof and axially fixed manner. A torque-proof axial guide is formed between the bearing bushing and the drive rod, such that the valve body unit is torque-proof while the rotor is turning and adjusts itself axially.

According to one advantageous embodiment, the torque-proof axial guide can be formed by an internal contour of the bushing opening, which has a non-circular cross-section, and an outer contour of the drive rod complementary to the internal contour in the region of the bearing bushing. Such a torque-proof axial guide can be realized particularly easily and thus inexpensively.

The rotor sleeve can expediently be axially supported on the bearing bushing and mounted rotatably thereon. As a result, the bearing bushing takes on an additional function, because it directly supports and bears the rotor sleeve.

According to an advantageous embodiment, a direct axial contact between the rotor sleeve and the bearing bushing can be configured as an axial slide bearing. Additionally or alternatively, a direct radial contact between the rotor sleeve and the bearing bushing can be configured as a radial slide bearing. These types of slide bearings are extremely compact, which supports the compact design for the expansion valve.

In a further embodiment, the rotor sleeve can be mounted so that it can rotate on the can base. As a result, the can takes on an additional function, because it can be used for the rotatable bearing of the rotor.

In a further advantageous embodiment, a direct radial contact between the rotor sleeve and the can base can be configured as a radial slide bearing. The compact design is also supported here.

According to a further embodiment, a rotor spring can be arranged in the rotor sleeve and can be axially supported on the can base and on the drive rod and can axially pretension the drive rod away from the can base. The positioning of the rotor spring in the rotor sleeve supports the compact design. The rotor spring eliminates any axial play between the rotor sleeve and the drive rod, which improves the precision of the expansion valve when controlling the flow opening.

An axial gap can expediently be formed between the rotor sleeve and the can base. A jamming of the rotor in the can thus be avoided. This in particular enables an axially floating bearing of the rotor in the can, wherein the rotor spring pretensions the rotor against the bearing bushing. The rotor is formed by the rotor sleeve and the magnet arrangement.

In a further embodiment, the rotor sleeve can comprise a sleeve threaded section, in which the internal threading is configured, and a sleeve guide section, which adjoins the sleeve threaded section on a side facing away from the bearing bushing. The drive rod can comprise a rod threaded section, in which the external threading is configured, and a rod guide section, which engages axially in the sleeve guide section, wherein an annular gap or a radial slide bearing is formed radially between the rod guide section and the sleeve guide section. A reliable drive coupling between the rotor sleeve and the drive rod is thus realized. The rod threaded section can be designed so as to be axially significantly shorter than the sleeve threaded section.

The magnet arrangement can be connected to the rotor sleeve in a torque-proof manner by means of at least one knurled connection. Two knurled connections can expediently be provided, each of which is located on an axial end section of the magnet arrangement. An annular radial gap can be configured axially between the knurled connections between the magnet arrangement and the rotor sleeve. This simplifies the assembly of the rotor.

In the simplest case, the magnet arrangement consists of a single permanent magnet, which has a magnetic positive pole and a diametrically opposed magnetic negative pole. A plurality of permanent magnets can also be provided, which alternate in the peripheral direction and accordingly form a plurality of magnetic positive poles and a plurality of magnetic negative poles, which alternate in the peripheral direction.

According to an advantageous embodiment, the valve body unit can have a stopper body for controlling the flow opening, which is arranged axially adjustable on the needle body and which has a stopper opening. The needle body comprises a needle tip aligned coaxially to the stopper opening for controlling a cross-section of the stopper opening through which the refrigerant can flow. The stopper opening has a significantly smaller opening cross-section than the flow opening. This configures the expansion valve as a two-stage expansion valve.

The stopper body and needle body can be adapted comparatively simply to different conditions of use. In order to now provide the expansion valve for different operating conditions, only a comparatively inexpensive adaptation of the stopper body and/or the needle body is required, while the expansion valve can otherwise be used unchanged.

According to an advantageous embodiment, the hydraulic flange can have a valve opening that leads to the flow opening and is covered by the housing. The valve body unit projects axially into this valve opening with the needle body and with the stopper body. In addition, a catching pressure spring is arranged in this valve opening, which is axially supported on the stopper body and directly or indirectly on the housing and which axially pretensions the stopper body away from the housing. In particular, the positioning of the catching pressure spring in the valve opening leads to a simple construction, which also supports a compact design.

An embodiment in which the stopper body has no contact with the hydraulic flange outside the flow opening is particularly advantageous. In particular, an axial guide or bearing of the stopper body on the hydraulic flange is omitted. This simplifies construction and reduces manufacturing costs.

In a further embodiment, the catching pressure spring can be arranged axially between the stopper body and the bearing bushing, wherein the catching pressure spring is axially supported on the bearing bushing and on the stopper body. As a result, the catching pressure spring generates an axial pretension directing the stopper body away from the bearing bushing. In particular, the catching pressure spring can thus pretension the stopper body against a valve seat that surrounds the flow opening.

According to a further advantageous embodiment, the needle body can have an annular collar which, in a closed position of the expansion valve, axially abuts the stopper body and closes the stopper opening. The needle tip can thus have an outer cross-section directly on the annular collar that is smaller than an inner cross-section of the stopper opening. When the annular collar is lifted off the stopper body, a cross-section in the stopper opening through which the refrigerant can flow is immediately released. The expansion valve thus reacts very precisely and requires only comparatively little axial force for lifting the needle body. This supports a compact design.

In a further embodiment, the stopper body can comprise a stopper base comprising the stopper opening and a plurality of gripping arms axially projecting from the stopper base, which axially surround the annular collar with radially inwardly projecting latching lugs, so that, in the event of an axial adjustment of the valve body unit during which the valve body unit moves into the housing, the needle body carries the stopper body along via the annular collar from a predefined switching stroke of the valve body unit and thereby axially adjusts it. The stopper body is in particular thereby lifted off a valve seat that surrounds the flow opening, so that the entire flow opening is opened.

An embodiment in which the gripping arms are arranged distributed in the peripheral direction on the stopper base so that gaps are formed between adjacent gripping arms through which the refrigerant can flow is advantageous. As a result, the refrigerant can also reach the stopper opening.

Expediently, the gripping arms can each form, at their end removed from the stopper base, radially outwards a step from which a protrusion projects axially away from the stopper base. The catching pressure spring can expediently be configured such that it is supported axially on the steps and radially inside on the protrusions. In the case of radially spring-elastic gripping arms, the catching pressure spring creates a form-fit securing of the gripping arms against an elastic deformation of the gripping arms radially outwards on the stopper body.

The stopper body can expediently be designed so that it can be clipped onto the needle body and is clipped onto the needle body. This can be realized, for example, by gripping arms that can be deformed radially elastically, which can be spaced apart from one another in the peripheral direction or are loosely abutting one another. The stopper body can then be clipped axially onto the needle body, wherein the gripping arms are radially driven apart by the annular collar until they engage behind the annular collar with the latching lugs and spring back into their initial position. The stopper body can be made of a plastic, for example.

A refrigeration circuit according to the invention, which is provided for guiding a two-phase refrigerant, comprises an evaporator for evaporating the refrigerant, a capacitor for condensing the refrigerant, a compressor for driving and compressing the refrigerant as well as an expansion valve of the type described above. The hydraulic flange between the compressor and the evaporator is integrated into the refrigeration circuit, in such a way, that during operation of the refrigeration circuit, the refrigerant flows through the refrigerant path of the hydraulic flange and through the flow opening in the hydraulic flange, which can be controlled using the expansion valve.

Other important features and advantages of the invention can be seen from the dependent claims, from the drawings and from the associated description of the figure based on the drawings.

It is understood that the above-mentioned features and those yet to be explained below can be used not only in the combination indicated in each case, but also in other combinations or on their own, without deviating from the scope of the invention defined by the claims. The components of a superordinate unit, such as a device, an apparatus, or an arrangement, which are described separately, having been mentioned above or to be mentioned below, can represent separate components of this unit or can form integral regions or sections of this unit, even if this is shown differently in the drawings.

Preferred exemplary embodiments of the invention are shown in the drawings by way of example and will be explained in more detail in the following description, wherein identical reference numbers refer to identical or similar or functionally identical elements.

BRIEF DESCRIPTION OF THE DRAWINGS

They show, schematically in each case.

DETAILED DESCRIPTION

Figure 1:
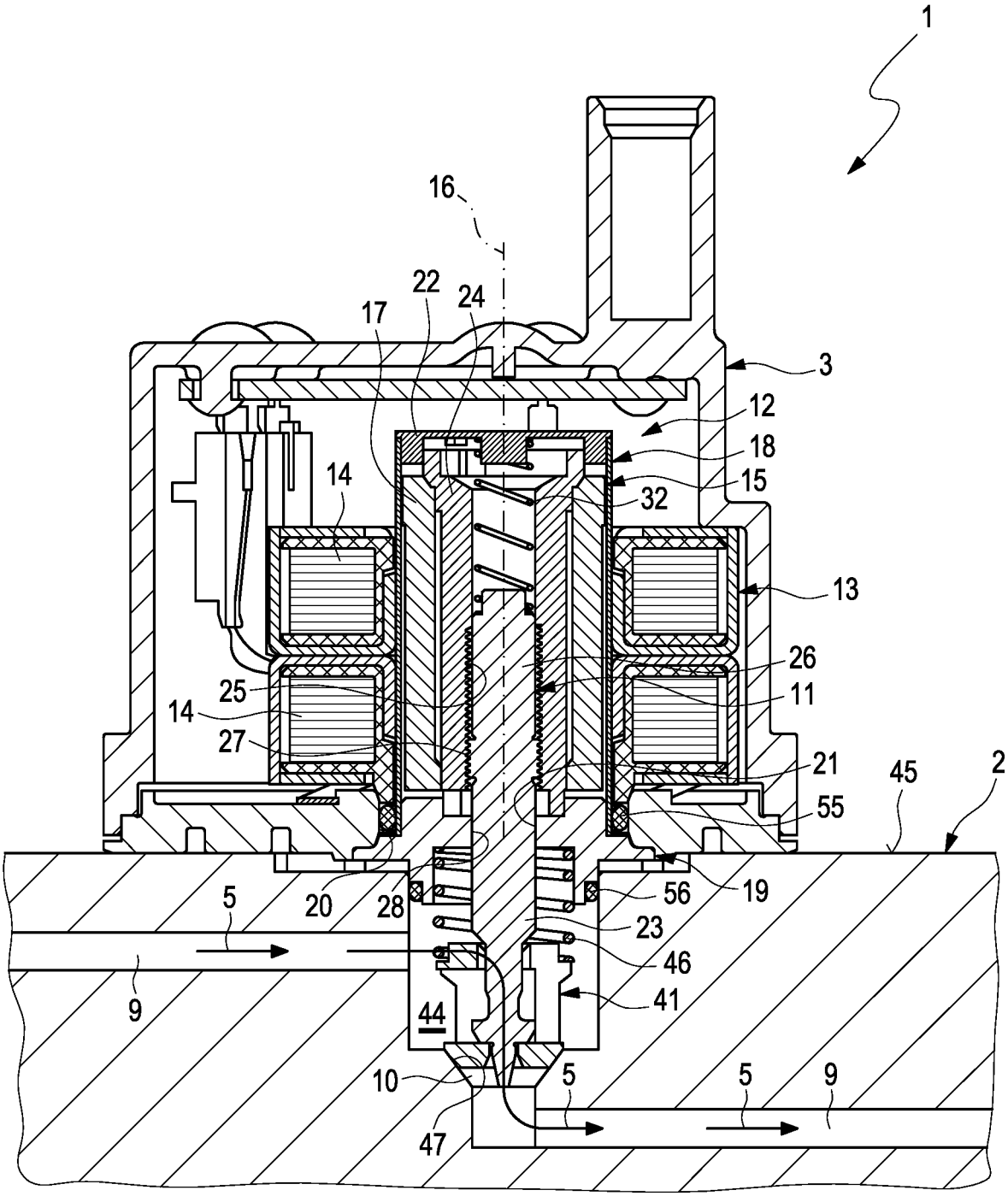
FIG. 1 shows a simplified longitudinal section through an expansion valve.

According to FIGS. 1 through 9, an electromotive expansion valve 1 comprises a hydraulic flange 2 and a housing 3, which is fastened to the hydraulic flange 2. The expansion valve 1 serves for use in a refrigeration circuit 4, reproduced in a highly simplified manner in FIG. 10, in which a two-phase refrigerant circulates. A refrigerant flow 5 is indicated by arrows in FIGS. 1, 3, 4, and 10. The refrigeration circuit 4 typically contains an evaporator 6 for evaporating the refrigerant, a condenser 7 for condensing the refrigerant, and a compressor 8 for driving and compressing the refrigerant. With its hydraulic flange 2, the expansion valve 1 is integrated into the refrigeration circuit 4 with respect to the refrigerant flow 5 between the compressor 8 and the evaporator 6. The refrigeration circuit 4 can be a component of an air conditioning system, in particular a motor vehicle. The refrigeration circuit 4 can also be used in order to cool a traction battery of a battery-electric vehicle.

The hydraulic flange 2 is used in order to integrate the expansion valve 1 into the refrigeration circuit 4. For this purpose, the hydraulic flange 2 according to FIG. 1 comprises a refrigerant path 9 for conducting the refrigerant and a flow opening 10 configured in the refrigerant path 9, through which the refrigerant can flow. The expansion valve 1 also comprises a valve body unit 11 for controlling the flow opening 10 and an electric motor 12 for axially adjusting the valve body unit 11. The electric motor 12 has a stator 13, which is arranged in the housing 3 in a torque-proof manner and comprises at least one stator coil 14. In the example shown, the stator 13 has two stator coils 14. The electric motor 12 can expediently be configured as a stepper motor. The electric motor 12 also comprises a rotor 15, which is mounted in the housing 3 concentrically to the stator 12 such that it can rotate about an axis of rotation 16. The rotor 15 comprises a cylindrical magnet arrangement 17, which is formed by means of at least one permanent magnet. If the magnet arrangement 17 comprises only a single permanent magnet, it can be provided in particular that the magnet arrangement 17 is formed by this permanent magnet.

The electric motor 12 also comprises a can 18 which is arranged in the housing 3 in a torque-proof manner concentrically to the axis of rotation 16 and radially between the rotor 15 and the stator 13. The can 18 is closed with a bearing bushing 19 at a first axial end facing the flow opening 10. The bearing bushing 19 is inserted into a housing opening 20 configured concentrically to the axis of rotation 16 on the housing 3. The housing opening 20 is closed by the bearing bushing 19 and sealed by means of a seal 55 arranged on the bearing bushing 19. The bearing bushing 19 is connected to the housing 3 and to the can 18 in a torque-proof manner and comprises a bushing opening 21 arranged concentrically to the axis of rotation 16. The can 18 is closed with a can base 22 at a second axial end facing away from the bearing bushing 19. The valve body unit 11 penetrates the bushing opening 21 concentrically to the axis of rotation 16 and comprises a needle body 23.

Figure 9:
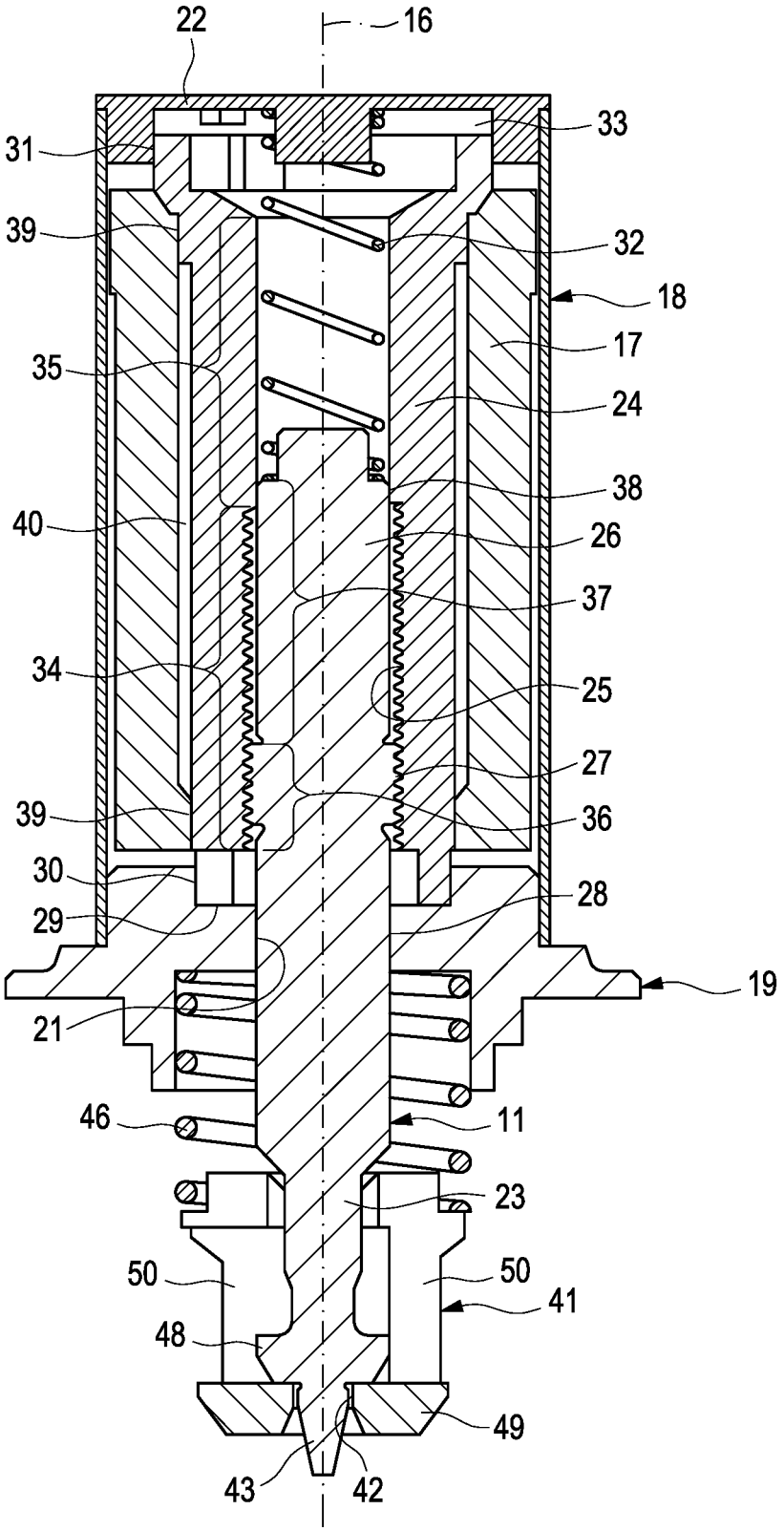
FIG. 9 shows a longitudinal section in the region of a rotor and a valve body unit.
Figure 10:
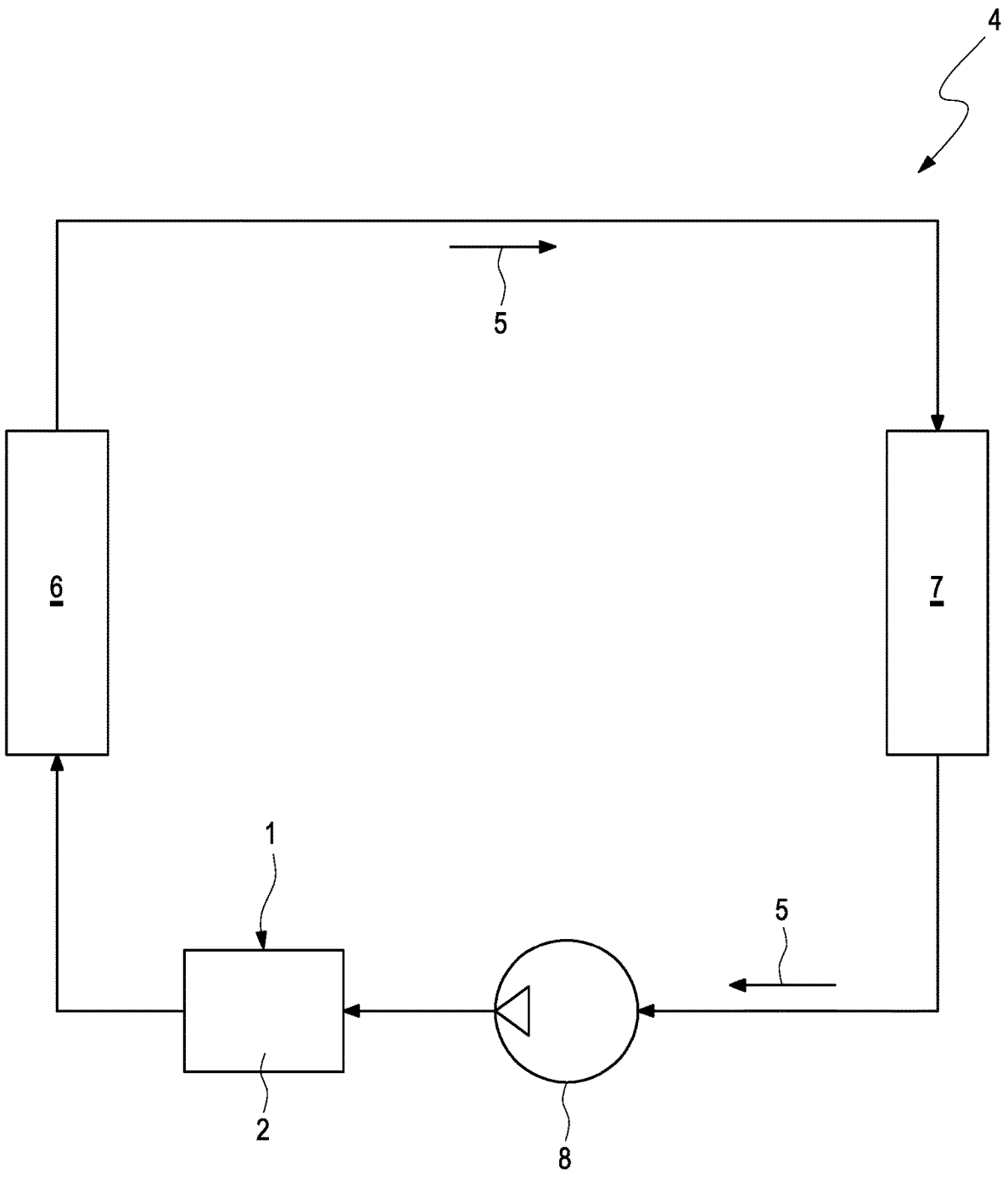
FIG. 10 shows a highly simplified schematic representation of a refrigeration circuit having an expansion valve.

According to FIGS. 1 and 9, the rotor 15 is equipped with a rotor sleeve 24, which is arranged in the magnet arrangement 17 concentrically to the axis of rotation 16. The rotor sleeve 24 is also connected to the magnet arrangement 17 in a torque-proof and axially fixed manner and is equipped with an internal threading 25. The valve body unit 11 comprises a drive rod 26, which extends axially up into the rotor sleeve 24 and, in the region of the rotor sleeve 24, has an external threading 27 which is in engagement with the internal threading 25. The drive rod 26 comprises the needle body 23. In the example shown, the drive rod 26 and the needle body 23 are formed by a single component, which can be produced by machining a metal rod, for example. A constructed embodiment is also conceivable in which the needle body 23 and the drive rod 26 are separate and attached to one another. In any case, the drive rod 26 and the needle body 23 are connected to one another in a torque-proof and axially fixed manner. The drive rod 26 extends through the bushing opening 21, wherein a torque-proof axial guide 28 is formed between the bearing bushing 19 and the drive rod 26, which is configured such that the valve body unit 11 is torque-proof and axially adjusts itself when the rotor 15 rotates.

In the expansion valve 1 presented here, the axial direction is defined by the axis of rotation 16 such that the axial direction extends parallel to the axis of rotation 16. The radial direction extends transversely to the axial direction and is in particular perpendicular to the axis of rotation 16. The peripheral direction U revolves around the axis of rotation 16.

The torque-proof axial guide 28 is expediently formed by an inner contour of the bushing opening 21 and an outer contour of the drive rod 26 in the region of the bearing bushing 19 that is complementary to the inner contour. For this purpose, the inner contour and the outer contour each have a non-circular cross-section. Polygonal cross-sections or circular cross-sections having at least one secant-shaped peripheral section are conceivable.

The rotor sleeve 24 is axially supported on the bearing bushing 19 and mounted rotatably thereon. In particular, a direct axial contact between the rotor sleeve 24 and the bearing bushing 19 can be configured as an axial slide bearing 29. Additionally or alternatively, a direct radial contact between the rotor sleeve 24 and the bearing bushing 19 can be configured as a radial slide bearing 30. The rotor sleeve 24 can furthermore be mounted such that it can rotate on the can base 22, wherein a direct radial contact between the rotor sleeve 24 and the can base 22 can be configured as a further radial slide bearing 31. Furthermore, according to FIG. 9, a rotor spring 32 is arranged in the rotor sleeve 24, being axially supported on the can base 22 and on the drive rod 26. Here, the rotor spring 32 is designed as a screw pressure spring, which is axially compressed in the assembled state so that it axially pretensions the drive rod 26 away from the can base 22. The rotor 15, which is formed here by the rotor sleeve 24 and the magnet arrangement 17, is supported in an axially floating manner in the can 18 by means of the radial slide bearings 30 and 31. As a result, the rotor spring 32 can drive the rotor 15 axially away from the can base 22 via the internal threading 25 and the external threading 27. In particular, an axial gap 33 can be formed axially between the rotor sleeve 24 and the can base 22.

The rotor sleeve 24 can expediently comprise a sleeve threaded section 34, in which the internal threading 25 is located, and a sleeve guide section 35, which adjoins the threaded section 34 on a side facing away from the bearing bushing 19. The drive rod 26 can now comprise a rod threaded section 36, in which the external threading 27 is located, and a rod guide section 37, which engages axially into the sleeve guide section 35. Radially between the rod guide section 37 and the sleeve guide section 35, a radial slide bearing 38 can expediently be configured.

In the example, the magnet arrangement 17 according to FIG. 9 is connected to the rotor sleeve 24 in a torque-proof manner and also axially fixed by means of two knurled connections 39. The two knurled connections 39 are located at the axial ends of the magnet arrangement 17 facing away from one another. According to the embodiment shown here, an annular radial gap 40 can be formed radially between the two knurled connections 39 between the magnet arrangement 17 and the rotor sleeve 24.

According to FIGS. 1 through 9, the valve body unit 11 comprises a stopper body 41 for controlling the flow opening 10, wherein the stopper body 41 is arranged on the needle body 23 in an axially adjustable manner and has a stopper opening 42. The stopper opening 42 is arranged coaxially to the axis of rotation 16. The needle body 23 comprises a needle tip 43 aligned coaxially to the stopper opening 42 for controlling a cross-section of the stopper opening 42 through which the refrigerant can flow. The needle tip 43 has a control contour in order to generate a predefined dependency between an axial stroke of the valve body unit 11 and the cross-section of the stopper opening 42 through which the refrigerant can flow. In other words, the needle body 23 controls the stopper opening 42 with its needle tip 43, while the stopper body 41 controls the flow opening 10.

According to FIGS. 1 through 4, the hydraulic flange 2 comprises a valve opening 44, which leads from an outer side 45 of the hydraulic flange 2 to the flow opening 10. The valve opening 44 is covered by the housing 3. The valve opening 44 is closed by the bearing bushing 19 and sealed by means of a seal 56 arranged on the bearing bushing 19. The valve body unit 11 projects axially with the needle body 23 and with the stopper body 41 into the valve opening 44. Furthermore, a catching pressure spring 46 is provided, which is arranged in the valve opening 44 and is axially supported on the stopper body 41 and directly or indirectly on the housing 3. In the example shown here, the catching pressure spring 46 is supported directly on the bearing bushing 19, which in turn is supported on the housing 3, so that the catching pressure spring 46 is supported here indirectly on the housing 3 via the bearing bushing 19. The catching pressure spring 46 is designed here as a screw pressure spring, which is compressed in the assembled state, so that it pretensions the stopper body 41 axially from the housing 3. In the example shown here, the valve body unit 11 is aligned to the valve opening 44 such that the stopper body 41 has no contact with the hydraulic flange 2 outside the flow opening 10. Merely to close the flow opening 10, the stopper 41 sits in a valve seat 47, which surrounds the flow opening 10 and is formed on the hydraulic flange 2. Apart from this valve seat 47, the hydraulic flange 2 thus does not form a guide for the stopper 41. The catching pressure spring 46 is arranged here axially between the stopper body 41 and the bearing bushing 19 and is supported directly axially in each case on the bearing bushing 19 and on the stopper body 41, wherein the catching pressure spring 46 axially pretensions the stopper body 41 away from the bearing bushing 19.

According to FIGS. 2 through 4 and 9, the needle body 23 comprises an annular collar 48, which, in a closed position of the expansion valve 1, axially abuts the stopper body 41 and, in doing so, covers and closes the stopper opening 42. According to FIGS. 2 through 9, the stopper body 41 comprises a stopper base 49 comprising the stopper opening 42 and a plurality of gripping arms 50 which project axially from the stopper base 49. In the example shown, the stopper body 41 has exactly 4 gripping arms 50, which are arranged uniformly distributed in the peripheral direction U on the stopper base 49. In this case, gripping arms 50 adjacent to one another in the peripheral direction U are configured separately, so that they either abut one another loosely or are spaced apart from one another via a gap 53. In particular, a configuration is thus possible in which the gripping arms 50 are configured in a radially spring-elastic manner.

The gripping arms 50 each comprise a latching lug 54, which is spaced apart from the stopper base 49 and projects radially inwards. The gripping arms 50 axially surround the annular collar 48 with the latching lugs 54. The engagement between the annular collar 48 and the gripping arms 50 results in a coupling for the axial force transmission between the needle body 23 and the stopper body 41 such that, in the event of an axial adjustment of the valve body unit 11 during which the valve body unit 11 moves into the housing 3, the needle body 23 carries the stopper body 41 along from a predefined switching stroke of the valve body unit 11 via the annular collar 48 and the gripping arms 50. This means that from the switching stroke, the stopper body 41 lifts off the valve seat 47 and thus completely releases the flow opening 10. A two-stage function for the expansion valve 1 is thus implemented.

Figure 5:
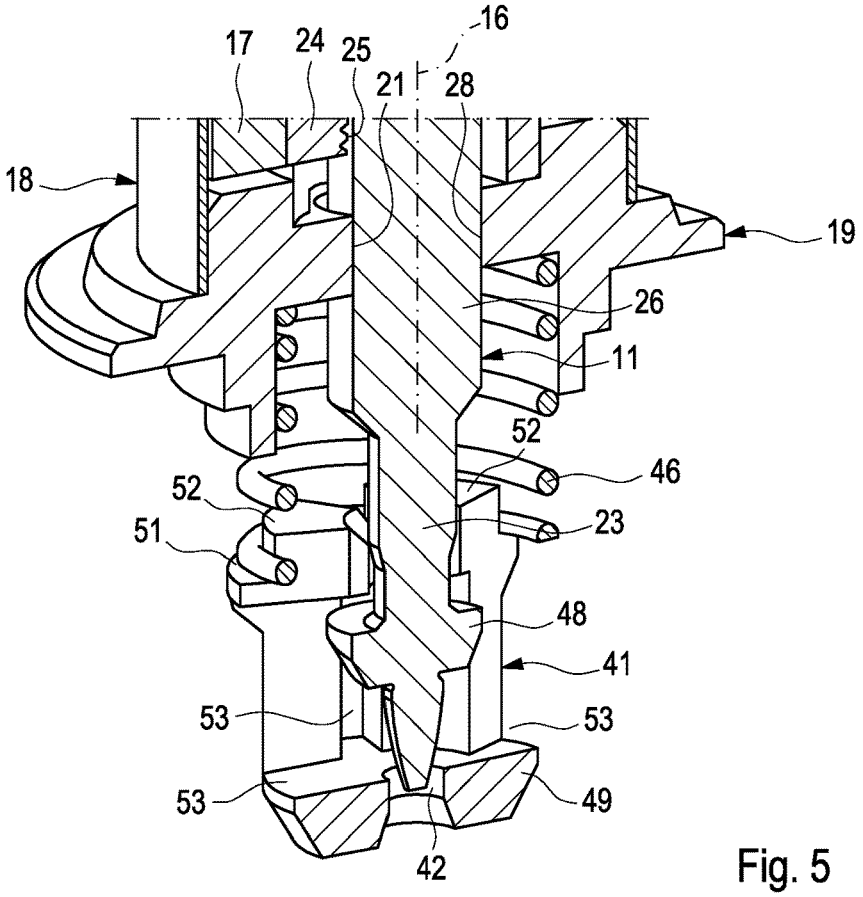
FIG. 5 shows an isometric longitudinal section in the region of a stopper body.
Figure 6:
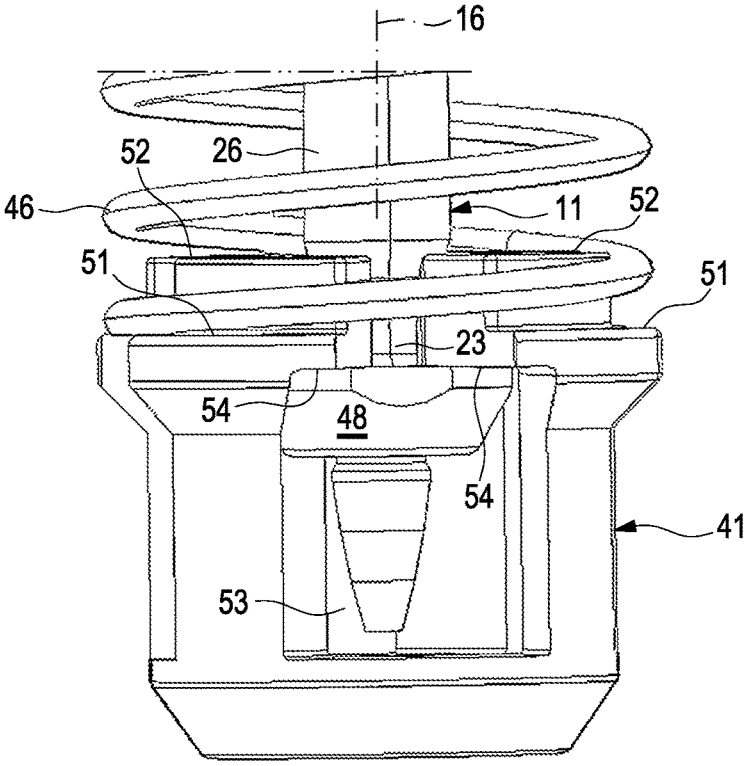
FIG. 6 shows a side view in the region of the stopper body.
Figure 7:
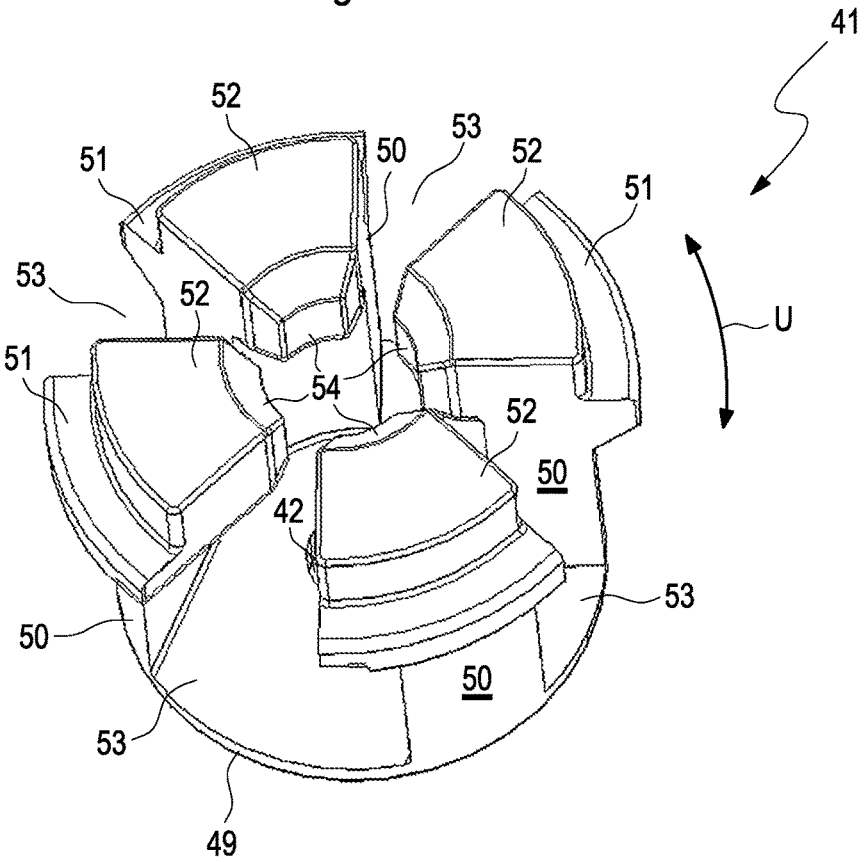
FIG. 7 shows an isometric view of the stopper body.
Figure 8:
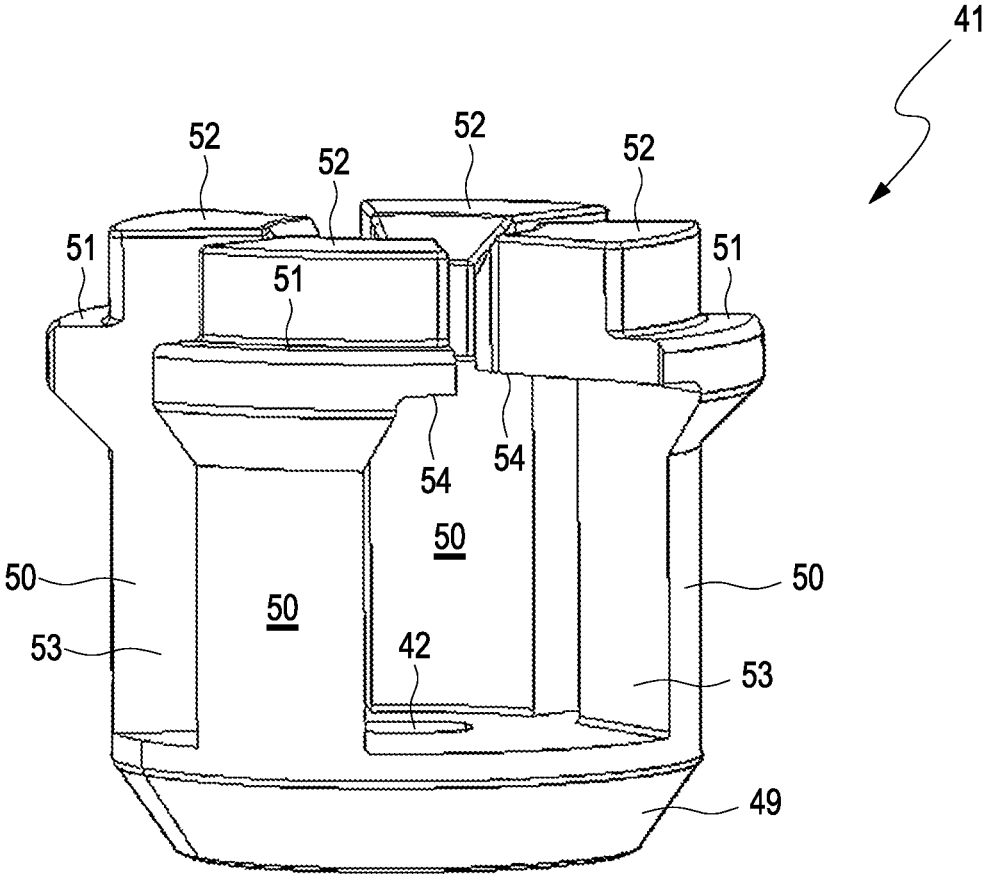
FIG. 8 shows an isometric view of the stopper body as in FIG. 7, but in a different viewing direction.

According to FIGS. 5 through 8, the gripping arms 50 can each form, at their end removed from the stopper base 49, radially inwards a latching lug 54 and radially outwards a step 51, from which step a protrusion 52 projects axially away from the stopper base 49. The catching pressure spring 46 and the stopper body 41 are expediently aligned with one another in such a way that the catching pressure spring 46 according to FIGS. 5 and 6 is supported axially on the steps 51 and radially inside on the protrusions 52. The catching pressure spring 46 thus secures the radially spring-elastic gripping arms 50 against a radially outwardly directed deformation.

As can be seen in particular from FIGS. 5 through 8, the gripping arms 50 are arranged distributed in the peripheral direction U on the stopper base 49 in such a way that gaps 53 are formed between adjacent gripping arms 50, through which the refrigerant can flow. The refrigerant can thus flow to the stopper opening 42 controlled by the needle tip 43, even when the stopper body 41 closes the flow opening 10. In connection with the radially spring-elastic gripping arms 50, the stopper body 41 can be configured such that it can be clipped onto the needle body 23. In the clipped-on state, the gripping arms 50 then surround the annular collar 48 with the latching lugs 54. For clipping on, the stopper body 41 can be pressed onto the needle body 23 axially via the needle tip 43. The annular collar 48 forces a radial evasion of the radial spring-elastic gripping arms 50 until the gripping arms 50 or their latching lugs 54 can engage behind the annular collar 48. According to FIG. 7, the latching lugs 54 can be chamfered on their side facing away from the stopper base 49 in order to simplify the radial displacement of the gripping arms 50 via the annular collar 48 when the stopper body 41 is placed onto the needle body 23.

Figure 2:
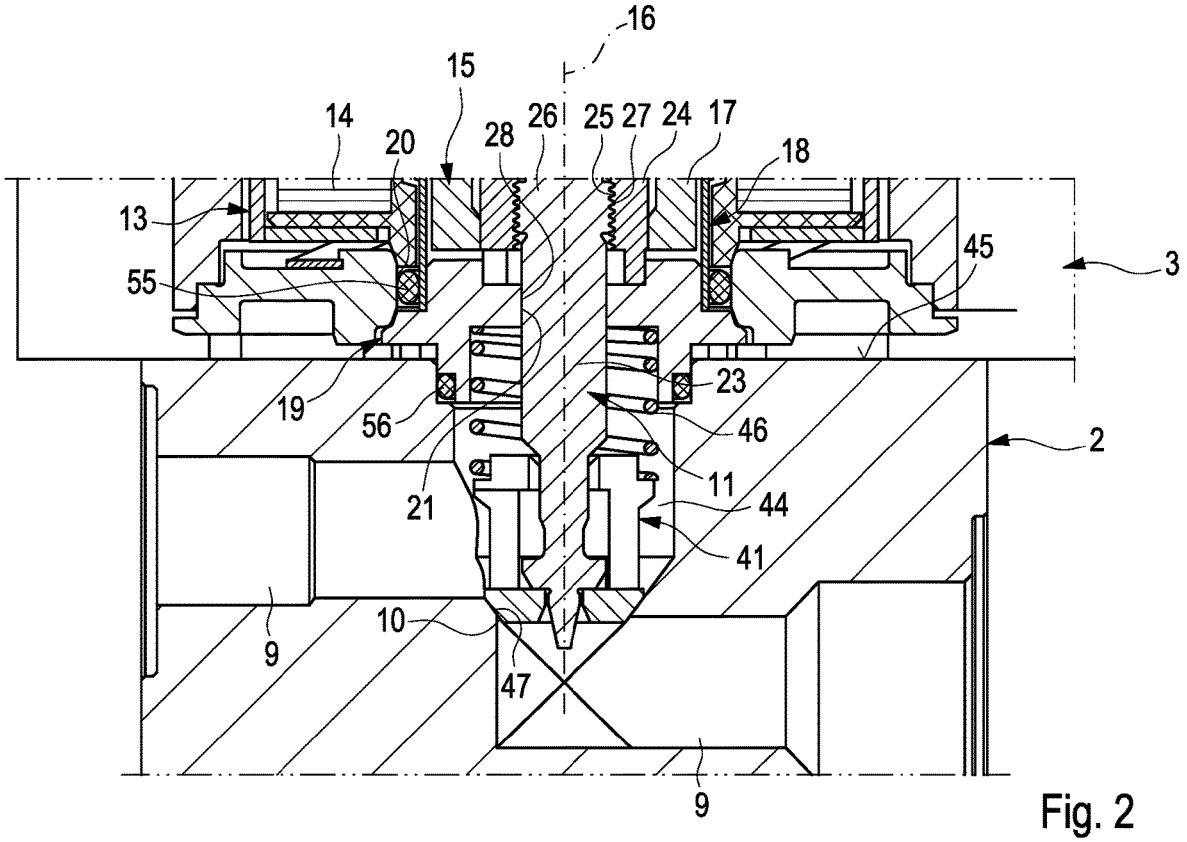
FIGS. 2 through 4 show in each case a longitudinal section of the expansion valve in the region of a flow opening in different states.

The two-stage functional principle of the expansion valve presented here is explained in further detail in the following with reference to FIGS. 2 through 4. FIG. 2 shows a closed position of the expansion valve 1. The stopper body 41 closes the flow opening 10 and the needle body 23 closes the stopper opening 42 with the annular collar 48. In this case, no refrigerant flows through the flow opening 10.

When the electric motor 12 is actuated, the rotor 15 rotates and thereby drives the valve body unit 11 axially. The needle body 23 is thus initially adjusted relative to the stopper body 41. Subsequently, the annular body 48 lifts off the stopper body 41, so that the needle tip 43 subsequently controls the cross-section of the stopper opening 42 through which the refrigerant can flow.

Figure 3:
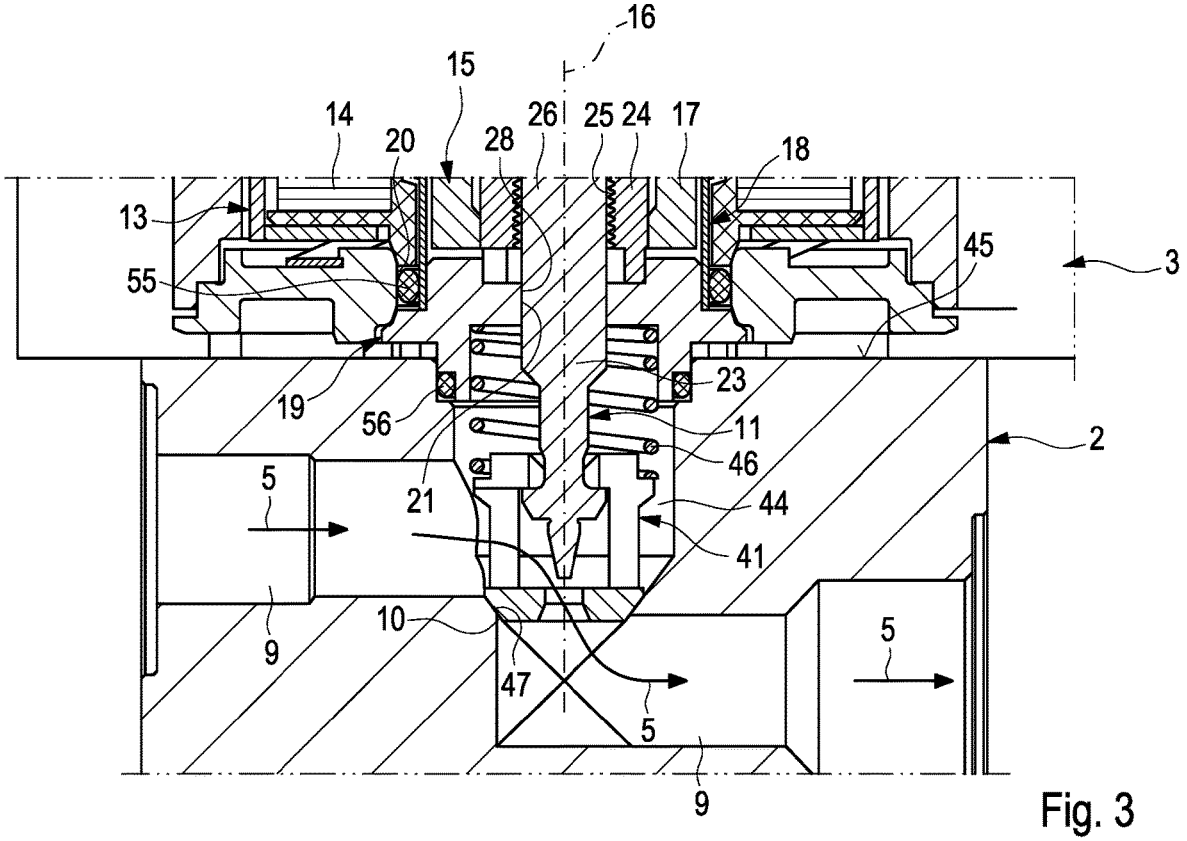

Up to a predefined switching stroke, which is shown in FIG. 3, the stopper body 41 remains in the valve seat 47, so that the cross-section of the flow opening 10 through which refrigerant can flow is formed exclusively by the cross-section of the stopper opening 42 through which refrigerant can flow. Upon this switching stroke, the annular collar 48 reaches the radially inwardly projecting latching lugs 54 of the gripping arms 50. In the case of an axial adjustment of the valve body unit 11 extending beyond this switching stroke, the needle body 23 then carries the stopper body 41 along via the annular collar 48 and the gripping arms 50 and lifts it off the valve seat 47.

Figure 4:
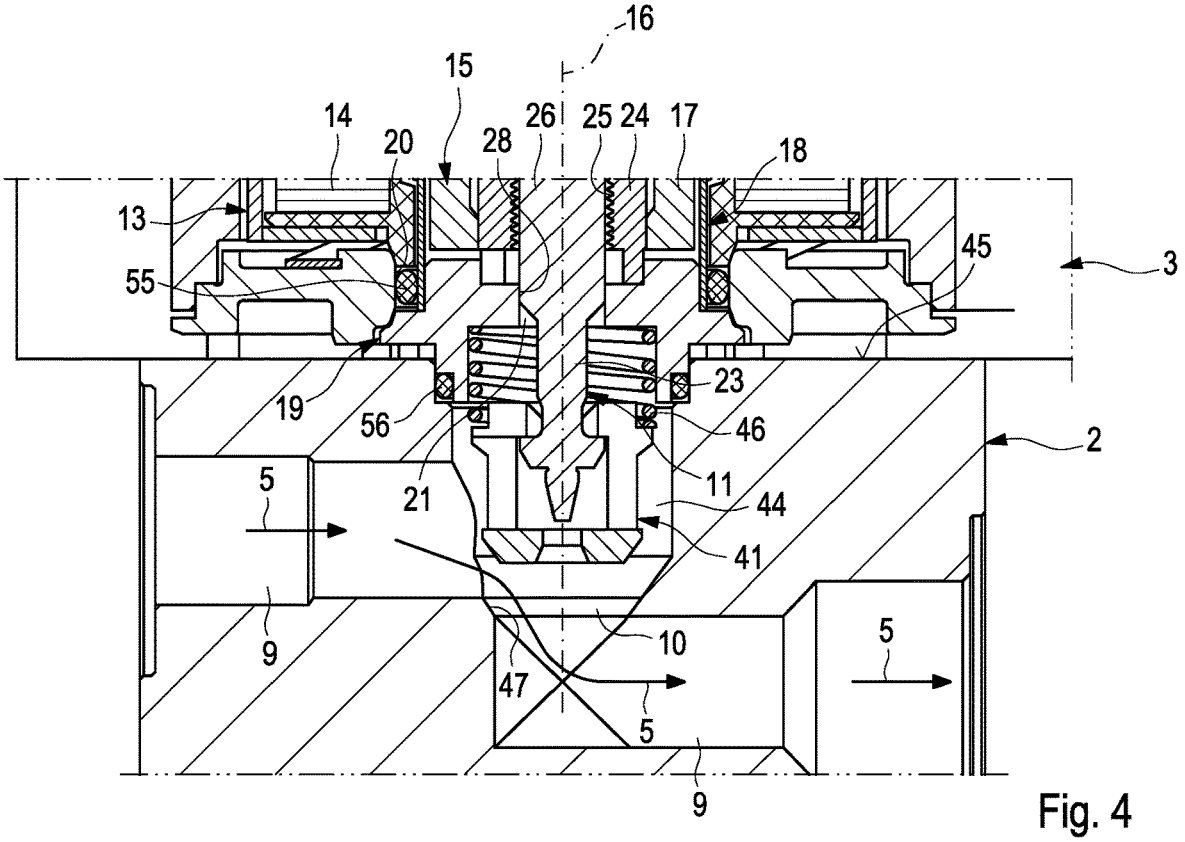

FIG. 4 now shows the maximum opened state of the expansion valve 1. The stopper body 41 is removed from the valve seat 47 at its maximum. The entire cross-section of the flow opening 10 is free and the refrigerant can flow through it.

The invention claimed is:

1. An electromotive expansion valve for a refrigeration circuit for expanding a two-phase refrigerant, comprising:

a hydraulic flange for integrating the expansion valve into the refrigeration circuit, the flange including a refrigerant path for conducting a refrigerant and a flow opening, which is configured in the refrigerant path and through which the refrigerant is flowable;

a housing fastened to the hydraulic flange;

a valve body unit for controlling the flow opening of the hydraulic flange;

an electric motor for axially adjusting the valve body unit;

the electric motor including a stator arranged in the housing in a torque-proof and axially fixed manner, the stator including at least one stator coil;

the electric motor further including a rotor mounted in the housing concentrically to the stator and rotatable about an axis of rotation, the rotor including a cylindrical magnet arrangement having at least one permanent magnet;

the electric motor further including a can arranged in the housing concentrically to the axis of rotation and radially between the rotor and the stator in a torque-proof and axially fixed manner;

the can closed at a first axial end with a bearing bushing, the bearing bushing inserted into a housing opening that is configured concentrically to the axis of rotation on the housing, the bearing bushing connected to the housing and to the can in a torque-proof manner, the bearing bushing including a bushing opening arranged concentrically to the axis of rotation;

the can closed at a second axial end with a can base;

the valve body unit extending through the bushing opening concentrically to the axis of rotation and including a needle body;

the rotor further including a rotor sleeve arranged in the magnet arrangement concentrically to the axis of rotation, the rotor sleeve connected to the magnet arrangement in a torque-proof manner and including an internal threading;

the valve body unit including a drive rod extending axially into the rotor sleeve, the drive rod including an external threading in a region of the rotor sleeve, which is in engagement with the internal threading of the rotor sleeve;

wherein the drive rod extends axially through the bushing opening; and wherein a torque-proof axial guide is disposed between the bearing bushing and the drive rod such that the valve body unit is torque-proof while the rotor is turning and adjusts itself axially.

2. The expansion valve according to claim 1, wherein:

the torque-proof axial guide is formed by an inner contour of the bushing opening, which has a non-circular cross-section, and an outer contour of the drive rod disposed in a region of the bearing bushing; and the outer contour of the drive rod complements the inner contour of the bushing opening.

3. The expansion valve according to claim 1, wherein the rotor sleeve is axially supported on the bearing bushing and is rotatably mounted thereon.

4. The expansion valve according to claim 3, wherein a direct axial contact between the rotor sleeve and the bearing bushing is configured as an axial slide bearing.

5. The expansion valve according to claim 1, wherein the rotor sleeve is rotatably mounted on the can base.

6. The expansion valve according to claim 5, wherein a direct radial contact between the rotor sleeve and the can base is configured as a radial slide bearing.

7. The expansion valve according to claim 1, further comprising a rotor spring arranged in the rotor sleeve, the rotor spring axially supported on the can base and on the drive rod, and axially biasing the drive rod away from the can base.

8. The expansion valve according to claim 1, wherein an axial gap is defined axially between the rotor sleeve and the can base.

9. The expansion valve according to claim 1, wherein:

the rotor sleeve has (i) a sleeve threaded section in which the internal threading is arranged and (ii) a sleeve guide section adjoining the sleeve threaded section on a side facing away from the bearing bushing;

the drive rod has (i) a rod threaded section in which the external threading is arranged and (ii) a rod guide section engaging axially in the sleeve guide section; and at least one of an annular gap and a radial slide bearing is formed radially between the rod guide section and the sleeve guide section.

10. The expansion valve according to claim 1, wherein the magnet arrangement is connected to the rotor sleeve in a torque-proof via at least one knurled connection.

11. A refrigeration circuit for conducting a two-phase refrigerant, comprising:

an expansion valve according to claim 1;

an evaporator for evaporating the refrigerant;

a condenser for condensing the refrigerant; and a compressor for driving and compressing the refrigerant;

wherein the hydraulic flange is integrated into the refrigeration circuit between the compressor and the evaporator.

12. The refrigeration circuit according to claim 11, wherein:

the torque-proof axial guide is formed by an inner contour of the bushing opening, which has a non-circular cross-section, and an outer contour of the drive rod disposed in a region of the bearing bushing; and the outer contour of the drive rod complements the inner contour of the bushing opening.

13. The refrigeration circuit according to claim 11, wherein the rotor sleeve is axially supported on the bearing bushing and is rotatably mounted thereon.

14. The refrigeration circuit according to claim 13, wherein at least one of:

a direct axial contact between the rotor sleeve and the bearing bushing is configured as an axial slide bearing; and a direct radial contact between the rotor sleeve and the bearing bushing is configured as a radial slide bearing.

15. The refrigeration circuit according to claim 11, wherein the rotor sleeve is rotatably mounted on the can base.

16. The refrigeration circuit according to claim 15, wherein a direct radial contact between the rotor sleeve and the can base is configured as a radial slide bearing.

17. The refrigeration circuit according to claim 11, further comprising a rotor spring arranged in the rotor sleeve, the rotor spring axially supported on the can base and on the drive rod, and axially biasing the drive rod away from the can base.

18. The refrigeration circuit according to claim 11, wherein an axial gap is defined axially between the rotor sleeve and the can base.

19. The refrigeration circuit according to claim 11, wherein:

the rotor sleeve has (i) a sleeve threaded section in which the internal threading is arranged and (ii) a sleeve guide section adjoining the sleeve threaded section on a side facing away from the bearing bushing;

the drive rod has (i) a rod threaded section in which the external threading is arranged and (ii) a rod guide section engaging axially in the sleeve guide section; and at least one of an annular gap and a radial slide bearing is formed radially between the rod guide section and the sleeve guide section.

20. The expansion valve according to claim 3, wherein a direct radial contact between the rotor sleeve and the bearing bushing is configured as a radial slide bearing.

* * * * *